United States Patent [19]

Parcell

[11] Patent Number: 4,594,865

[45] Date of Patent: Jun. 17, 1986

[54] SEQUENTIAL KEYLESS LOCK

[76] Inventor: Louise E. Parcell, 5102 SW. 131 Ave., Miami, Fla. 33175

[21] Appl. No.: 678,748

[22] Filed: Dec. 6, 1984

[51] Int. Cl.[4] ..... E05B 37/00

[52] U.S. Cl. ..... 70/313; 292/32; 292/150

[58] Field of Search ..... 70/313; 292/32, 42, 292/43, 44, 150, 16

[56] References Cited

U.S. PATENT DOCUMENTS

| | | | |
|---|---|---|---|
| 378,016 | 2/1888 | Morrow | 292/42 |
| 530,862 | 12/1894 | Teed | 292/42 |
| 543,908 | 8/1895 | Stone | 292/32 |
| 1,216,765 | 2/1917 | Anderson | 292/44 |
| 1,653,184 | 12/1927 | Kolumbus | 292/42 |
| 1,684,134 | 9/1928 | Mesurier | 292/32 |
| 2,936,189 | 5/1960 | Pearson | 292/42 |
| 3,160,431 | 12/1964 | Anderson et al. | 292/42 |

FOREIGN PATENT DOCUMENTS

| | | | |
|---|---|---|---|
| 318393 | 12/1953 | Fed. Rep. of Germany | 292/150 |

*Primary Examiner*—Kenneth J. Dorner
*Assistant Examiner*—Shirish Desai
*Attorney, Agent, or Firm*—Beveridge, DeGrandi & Weilacher

[57] ABSTRACT

This is a security device to be attached to an inside security grill. It would protect the unauthorized entry of individuals and provide emergency departure from a secured area. It is a sequentially operated keyless lock primarily for use as an escape device but has application on automobiles, medicine cabinets, closets and child-proof areas as it makes access difficult. It is sequential in that opening the lock requires the use of both hands and three physical movements. Step One must be done and remain stationary before Step Two can be accomplished. While Step One still remains stationary and after Step Two is completed, only then can Step Three be completed, opening the lock. If the sequence is interrupted before completion, the lock cannot be opened.

4 Claims, 6 Drawing Figures

SEQUENTIAL KEYLESS LOCK

BACKGROUND AND BRIEF SUMMARY OF THE INVENTION

This invention relates to a keyless lock operated in a specific sequence, which when secured to an inside security grill, door or window, permits a person to quickly unlock the device without the need of a key.

At the present time, many types of security devices or locks exist for the doors and windows of homes, offices, etc. Most of them do not provide a means of escape in case of fire or some other disaster. Those that do provide an exit also require a key for operating the lock, which key may not be readily available for use during an emergency.

The keyless lock of this invention operates in a specific sequence—there are three distinct steps, i.e. three separate physical movements that must be performed and which are interrelated through the mechanical functioning of the lock.

Although the procedure of opening the lock could be known by anyone trying to enter the premises without authorizaton, the lock would still keep an area secure because of its sequential operation and the need for the use of both hands for its operation in unlocking the lock. It would be almost impossible for an intruder to get both hands or other instruments through the inside of the security grill and follow the sequence of steps which are necessary to open the lock, namely: STEP ONE—With the right hand, push the upper shelf top block 10 of top block 8 and the lower shelf bottom block 11 of bottom block 9 together. While you continue to hold top block 8 and bottom block 9 together, carry out STEP TWO—With the left hand, pull the bolt 21 out of its core or opening 22 so that the ridge member 23 clears the clip notch 24 and is pulled out of the casing 2. While continuing to do step one (holding top block 8 and bottom block 9 together) do STEP THREE—Slide the clip 20 over to the left and out of top block 8 and bottom block 9 and casing 2, clearing the upper cube 19 and lower cube 18 to permit opening of the lock.

BRIEF DESCRIPTION OF THE DRAWINGS

The following description is given in conjunction with the drawings in which.

DESCRIPTION

Figure 1:
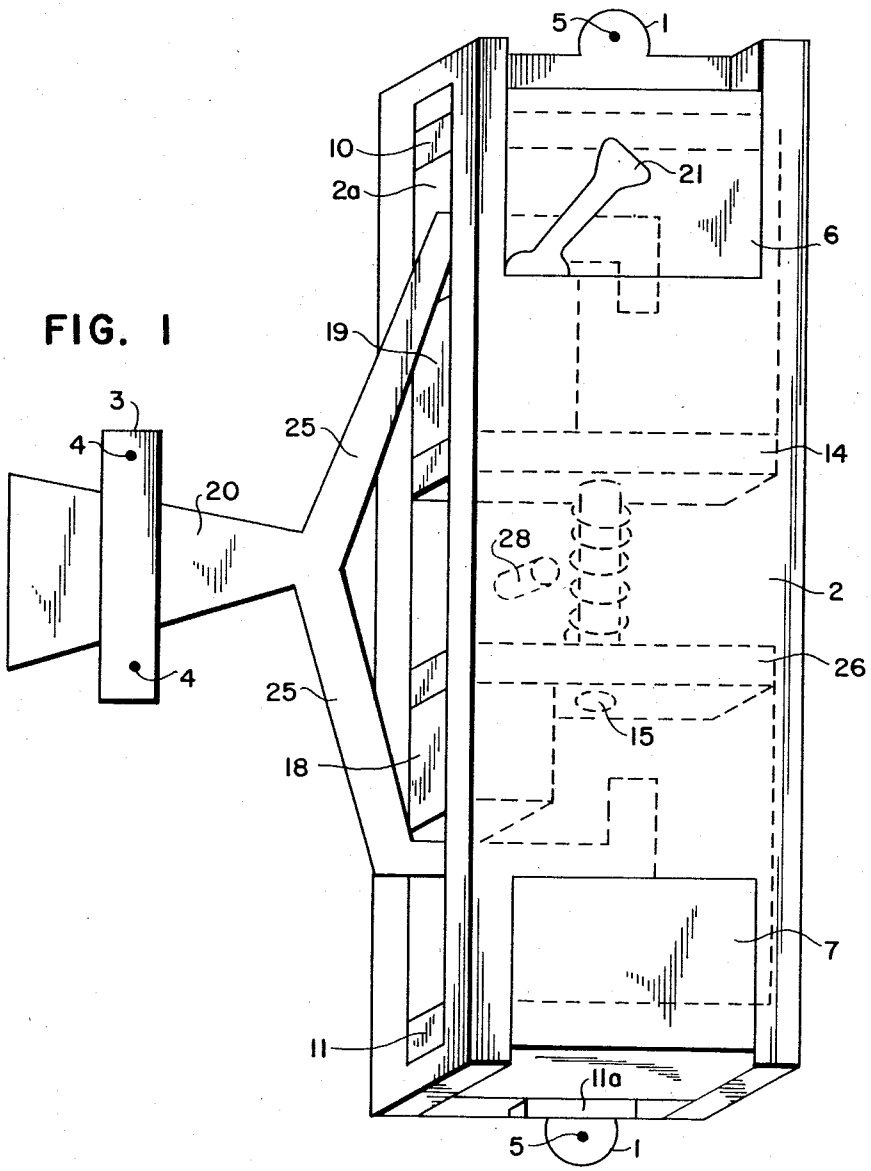
FIG. 1 is a front view of the sequentially operated keyless lock inside its stationary case as it would appear attached to a wall and security grill or door. The dotted lines represent the position of the inside parts which are not visible to the operator.

FIG. 1 illustrates the outward appearance as the stationary case or casing 2 attached to a wall 1 by screws 5 and the clip case 3 fastened, such as by screws 4, to a security grill or similar device or member, such as a door or window, to prohibit entry.

Figure 2:
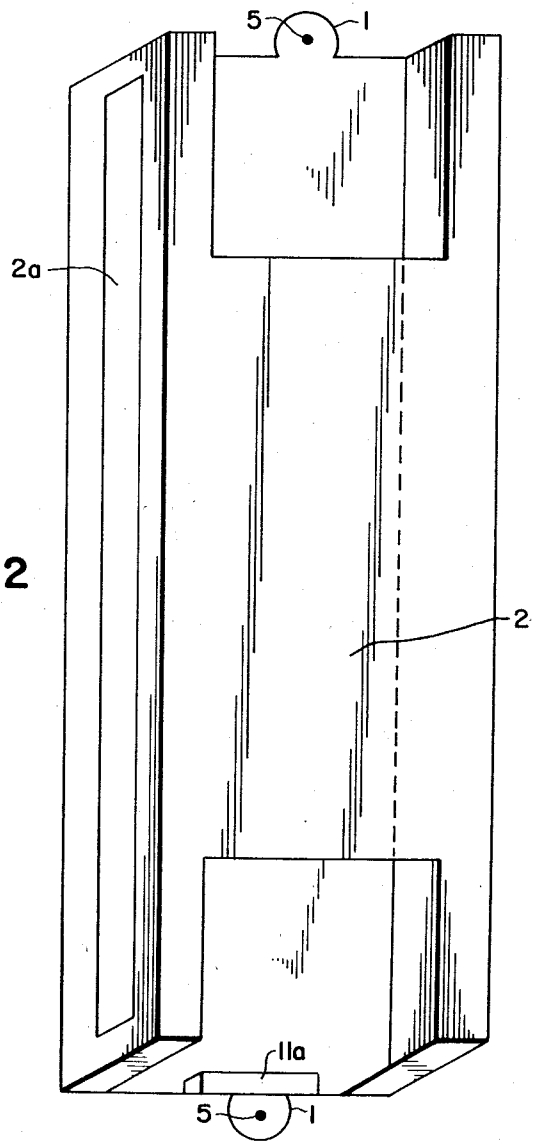
FIG. 2 is a front view of the stationary case which contains the moving parts of the sequential lock and would be attached to a wall or other stationary object.
Figure 3:
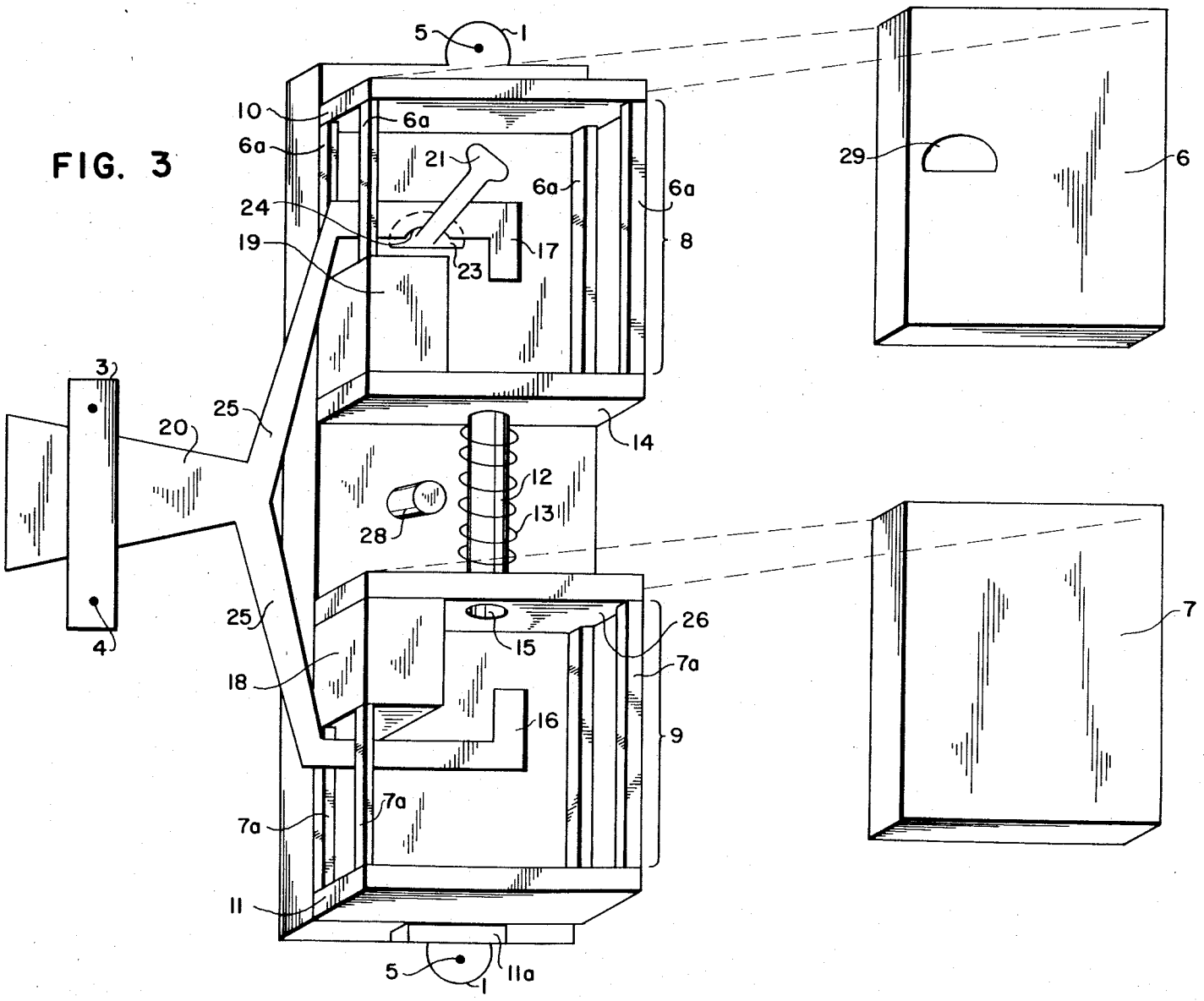
FIG. 3 is a front view with the stationary case and two block plates removed for viewing the inside parts which are operated in a sequence of steps for opening the keyless lock.

Referring to FIG. 2, the stationary case or casing 2 is separated from the movable inside parts of the mechanism illustrated in FIG. 3. The casing is a hollow rectangular member having an elongated opening **2*a* on one side panel through which L-shaped hook members 16 and 17 are moved out of casing 2 when lever 20 having arms 25 integral with L-shaped members 16 and 17 is moved laterally away from the casing so as to unlock the device. The front panel of casing 2 is provided with recessed portions of sufficient depth so that a person can grasp the top of block 10 and the bottom of block 11 with one hand and vertically move these members together, as will be explained infra, so that pin 21 can be withdrawn and lever 20 and hook members 16 and 17 can be moved laterally out of casing 2** by the person's other hand.

Referring to FIG. 3 the top block plate 6 and bottom block plate 7 are shown removed from the top block 8 and bottom block 9, respectively. This enables the viewing of the actual mechanism and sequence of events which must occur in order to open the lock. FIG. 3 represents the appearance of the inside mechanism when it is in the locked position.

Block 8 consists of top block plate 6 which is secured to the front of upper shelf top block 10 and of lower shelf top block or platform 14, so that block 8 vertically moves as a unit within casing 2. In addition, or alternatively, spacing members **6*a* are fastened to each of the corners of the undersurface of top block 10 and the upper surface of lower block 14. The upper surface of block 14 has an upper cube or blocking means 19 securely mounted thereon and, as shown in FIG. 3, a pair of the spacing members 6*a* extend between and are secured to the undersurface of block 10 and the upper surface of cube 19**.

Bottom block 9 consists of bottom block plate 7 which is secured to the front of lower shelf bottom block 11 and of upper shelf bottom block 26 so that block 9 also vertically moves as a unit within casing 2. In addition, or alternatively, spacing members **7*a* are fastened to each of the corners of the undersurface of block 26 and the upper surface of block 11. The undersurface of block 26 has a lower cube or blocking means 18 securely fastened thereto. Again, as shown in FIG. 3, a pair of the spacing members 7*a* extend between and are secured to the upper surface of block 11 and the undersurface of cube 18**.

A stop member **11*a* is securely fastened to the lower end of the back surface of casing 2 so that the undersurface of lower block 11 engages stop member 11*a* when the mechanism is in the position shown in FIG. 3 where blocks 8 and 9 are spaced apart from each other. Thus, the lowest position of block 9 as it moves vertically downwardly within casing 2 is determined by stop member 11*a***.

Figure 4:
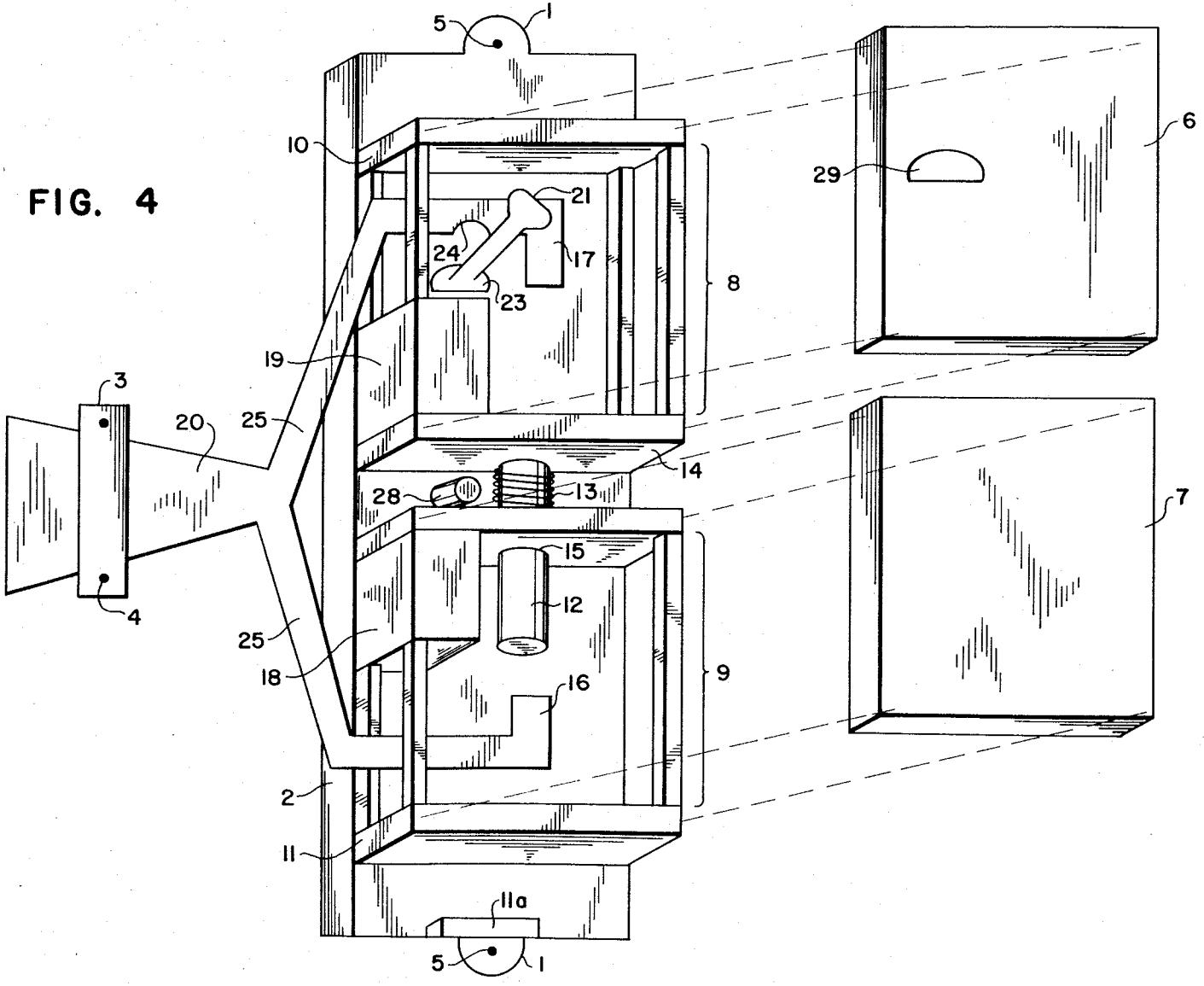
FIG. 4 is a front view of the sequential lock and illustrates the first step of operation—pushing the two blocks together.

FIG. 4 depicts the position of the movable parts for the FIRST STEP in the sequence required to open the lock. Two fingers of the right hand must be used—one finger is placed on the upper shelf top block 10 and the other finger is placed on the lower shelf bottom block 11, pushing the top block 8 and bottom block 9 together and toward each other until the lower shelf top block or platform 14 and upper shelf bottom block 26 each touch the bar 28 extending outwardly from and secured at one end to the back wall of casing 2, which prohibits any further movement. The elongate sliding pin 12 and compression spring 13 enable this action to occur. The sliding pin 12 is permanently attached to the undersurface of lower shelf top block or platform 14. The spring 13 is mounted between the oppositely facing surfaces of platforms 14 and 26 and when the spring 13 is squeezed together because of movement of platforms 14 and 26 toward each other, the elongate sliding pin 12 easily slides through the pin hole 15 in the upper shelf bottom block or platform 26 and enters the empty space of the bottom block 9. As this occurs the lower L-shaped clip hook 16 is now free of the lower cube 18 and the top L-shaped clip hook 17 is simultaneously free of the upper cube 19. Cubes 18 and 19 are, in effect, blocking means since they prevent or block the movement of the hooks out of the case 2 when platforms 14 and 26, which are part of blocks 8 and 9 respectively, are urged apart by spring 13 (see FIG. 3). One end of spring 13 is preferably fastened to the undersurface of platform 14 and its other end can either be fastened to the upper surface of block 26 or can merely be in contact with such surface about the periphery of pin hole 15. Spring 13 is of such construction that when lower block 9 has its undersurface of block 11 at rest against stop member 11*a*, upper block 8 is urged upwardly by the action of spring 13 to the position shown in FIG. 3 and is held there by such spring.

When the mechanism is in the position shown in FIGS. 1 and 3, it is impossible to slide the clip or lever 20 laterally away from and out of the top block 8 and bottom block 9 because the upper clip hook 17 cannot slide past the bolt 21. However, when the mechanism is in the position shown in FIG. 4, and the bolt 21 is removed from opening 22 (see FIG. 5), the clip or lever 20 can easily slide laterally away from the casing 2 through longitudinal opening 2*a* since hooks 16 and 17 are no longer able to be engaged by cubes 18 and 19, respectively.

Figure 5:
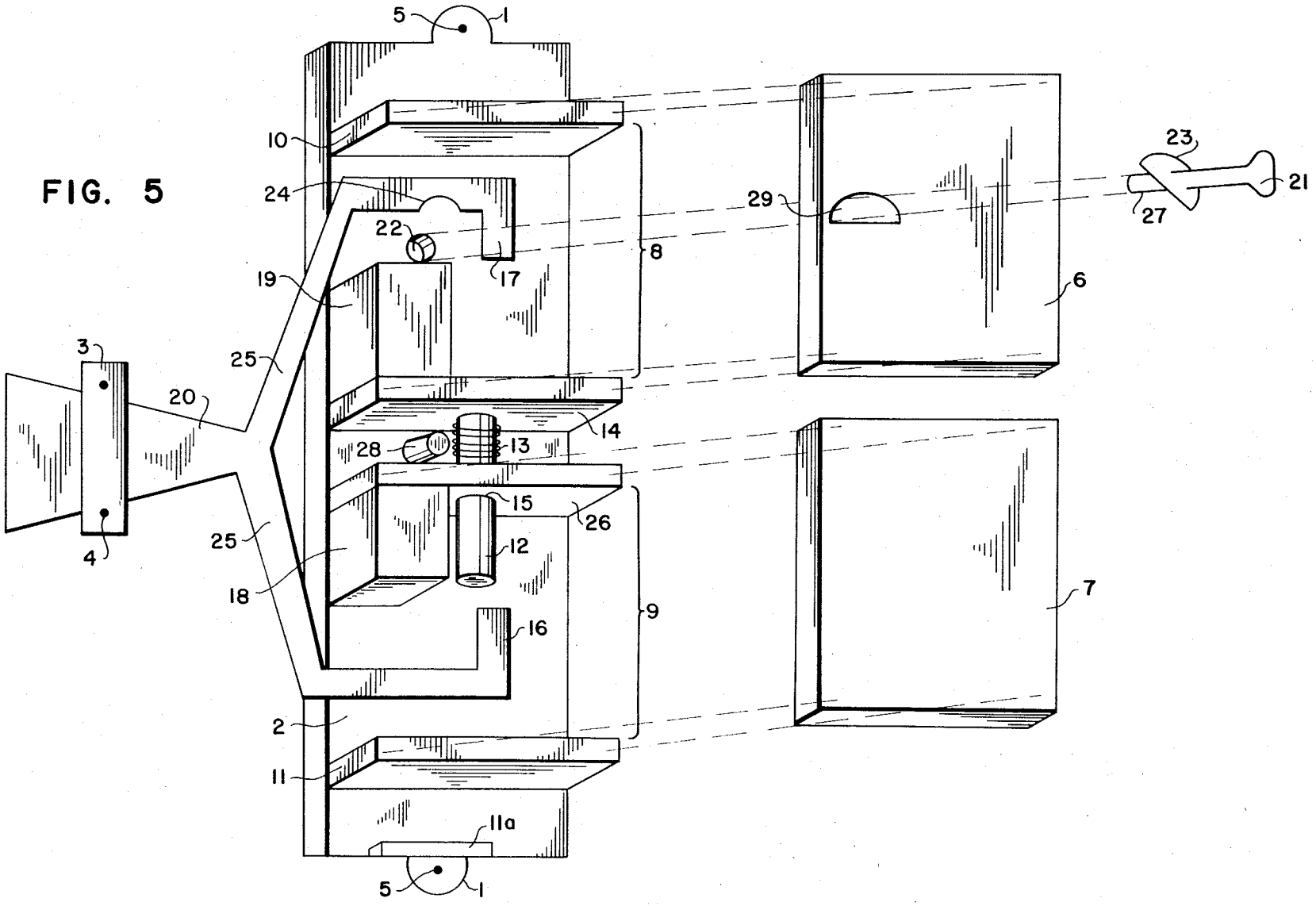
FIG. 5 is a front view of the sequential lock and illustrates the second step of operation—pulling the bolt out of its core while the two blocks are still being pushed together.

FIG. 5 depicts the position of the movable parts for the SECOND STEP in the sequence required to open the lock. It is necessary that the top block 8 and bottom block 9 remain pushed together with the respective surfaces of blocks 14 and 26 touching the bar 28 secured to the back wall of casing 2 so that the bolt 21, including the end 27 and ridge 23, can be pulled out of the core or opening 22 and through the bolt opening 29 on the top block plate 6.

It is impossible to pull the bolt 21 out unless the top block 8 and bottom block 9 are pushed together making it possible for the bolt ridge 23 to pass by the clip notch 24 on the bottom edge of the arm of the L-shaped hook 17. The notch 24 is spaced from the hook portion which engages cube 19 when the mechanism is in the locked position, i.e. when the hook 17 fails to clear the cube 19 and thus lever 20 cannot be removed from casing 2.

Thus far, it is necessary for the top block 8 and bottom block 9 to be squeezed together, i.e. each move vertically within casing 2 at the same time so that the bolt 21 can be removed.

Figure 6:
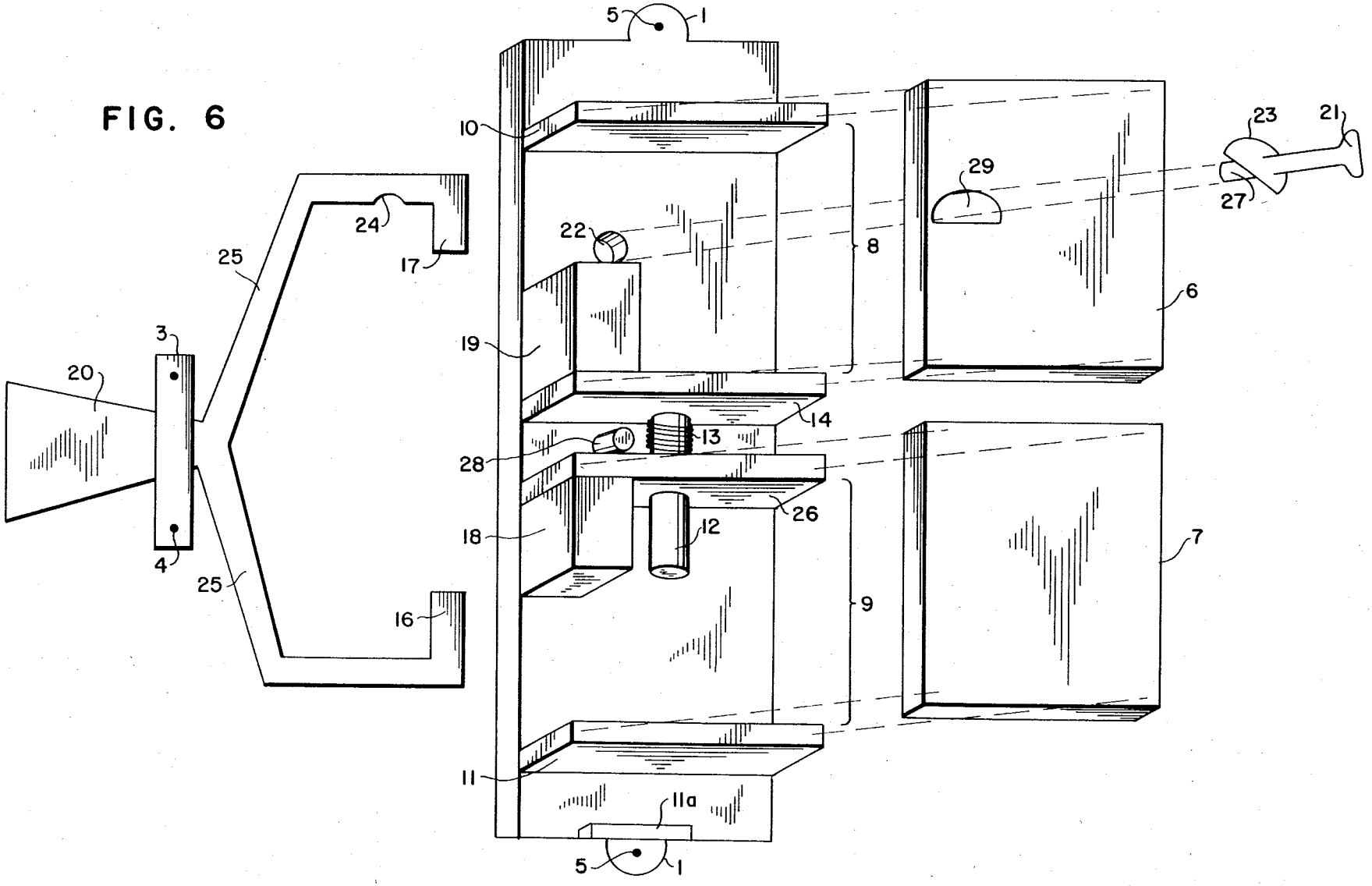
FIG. 6 is a front view of the sequential lock and illustrates the third step of operation—sliding the clip over and out of the two blocks while the two blocks are still being pushed together. This is the final step which requires that Step One and Step Two first be done.

FIG. 6 depicts the position of the movable parts for the THIRD STEP in the sequence required to open the lock. It is to be noted that the top block 8 and bottom block 9 must still be pushed together touching the bar 28 and the bolt 21 must be removed prior to execution of the THIRD STEP of sliding the lever or clip 20 laterally through the clip case 3 in a direction substantially perpendicular to the case 2 until the laterally extending clip arms 25 touch the clip case 3. At this position the upper clip hook 17 and lower clip hook 16 have cleared the upper cube 19 and lower cube 18, respectively. Now the lever or clip 20 is free of and no longer positioned inside the top block 8 and bottom block 9. The security grill, door, window, drawer, or whatever the clip case 3 is attached to can be swung open since the clip 20 is no longer secured inside the top block 8 and bottom block 9.

It is necessary to summarize the SEQUENCE of STEPS (THREE) required to open the lock: (ONE) Push the top block 8 and bottom block 9 together; (TWO) Pull the bolt 21 out; and (THREE) slide the clip 20 out of the top block 8 and bottom block 9 located within casing 2 to permit opening of the lock.

I claim:

1. A keyless lock for releasably securing two members comprising a casing adapted for mounting on one of said members, a pair of spaced platforms disposed within said casing and adapted for movement relative to each other a spring mounted between facing portions of said platforms and urging said platforms away from each other, an elongate pin secured to one of said platforms and extending toward said other platform, an opening passing through said other platform and adapted to receive said pin therethrough when said platforms are urged toward each other, blocking means affixed to each non-facing surface of said platforms, a clip adapted to be slidably affixed to said other member for movement in a direction substantially perpendicular to said casing, said clip having a pair of laterally extending arms, each terminating in an L-shaped hook, said L-shaped hooks extending within said casing through openings in said casing when said two members are secured, said L-shaped hooks being prevented from being withdrawn from said casing by the hooks coming into contact with said blocking means when said spring urges said platforms away from each other, one of said L-shaped hooks having a notch along one edge spaced from its hook portion, and a bolt removably mounted within said casing and extending through said notch to prevent lateral withdrawal of said L-shaped hook from said casing.

2. The keyless lock as defined in claim 1 wherein said bolt has a ridge member affixed thereto for engaging said L-shaped hook adjacent said notch, said ridge member preventing withdrawal of said bolt from said casing during such engagement.

3. The keyless lock as defined in claim 1 including a clip case adapted to be secured to said other member, said clip disposed between said case and said other member when said clip case is secured to said other member.

4. The keyless lock as defined in claim 1 including a block means affixed to each of said spaced platforms for movement with said platforms, portions of said block means being accessible through openings in said casing for grasping and forcing said spaced platforms toward each other.

* * * * *